US009291069B2

(12) United States Patent
Leogrande et al.

(10) Patent No.: US 9,291,069 B2
(45) Date of Patent: Mar. 22, 2016

(54) INSTRUMENT PORT SEAL FOR RF MEASUREMENT

(75) Inventors: John A. Leogrande, West Hartford, CT (US); Peter L. Jalbert, Granby, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 885 days.

(21) Appl. No.: 12/950,257

(22) Filed: Nov. 19, 2010

(65) Prior Publication Data

US 2011/0062966 A1 Mar. 17, 2011

Related U.S. Application Data

(63) Continuation of application No. 11/621,671, filed on Jan. 10, 2007, now Pat. No. 7,918,642.

(51) Int. Cl.

| | |
|---|---|
| ***F01D 25/00*** | (2006.01) |
| ***F01D 11/02*** | (2006.01) |
| ***F01D 17/02*** | (2006.01) |
| ***F01D 17/20*** | (2006.01) |
| ***F01D 21/00*** | (2006.01) |

(52) U.S. Cl.

CPC ..... *F01D 11/025* (2013.01); *F01D 17/02* (2013.01); *F01D 17/20* (2013.01); *F01D 21/003* (2013.01); *F05D 2250/30* (2013.01); *Y10T 29/4932* (2015.01)

(58) Field of Classification Search

USPC ..... 416/61; 415/118, 173.1; 324/644

See application file for complete search history.

(56) References Cited

U.S. PATENT DOCUMENTS

| | | | |
|---|---|---|---|
| 3,502,967 | A | 3/1970 | Bridges et al. |
| 3,761,201 | A | 9/1973 | Silverstein et al. |
| 3,899,267 | A | 8/1975 | Dennis et al. |
| 4,060,329 | A | 11/1977 | Ellis |
| 4,080,823 | A | 3/1978 | Stargardter |
| 4,326,804 | A | 4/1982 | Mossey |
| 4,330,234 | A | 5/1982 | Colley |
| 4,359,683 | A | 11/1982 | Chivers |

(Continued)

FOREIGN PATENT DOCUMENTS

| | | |
|---|---|---|
| GB | 1 277 748 | 6/1972 |
| GB | 2 063 001 | 5/1981 |

(Continued)

OTHER PUBLICATIONS

European Search Report for EP Application No. 06256306.9, Jun. 2, 2010.

(Continued)

*Primary Examiner* — Richard Edgar

(74) *Attorney, Agent, or Firm* — Carlson, Gaskey & Olds, P.C.

(57) ABSTRACT

An apparatus includes a blade clearance detection system. A probe is configured to communication detection frequencies from and gather reflected signals for the blade tip detection system. The probe has an end supported relative to the casing. A material provides a reference point. The blade tip clearance detection system is configured to generate a first detection frequency configured to pass through the material to detect the position of a target structure, generate a second detection frequency configured to reflect from and detect the reference point, and determine a position of a surface approximate to the target structure based upon the reference point.

7 Claims, 3 Drawing Sheets

(56) References Cited

U.S. PATENT DOCUMENTS

| | | | | |
|---|---|---|---|---|
| 4,384,819 | A | 5/1983 | Baker | |
| 4,752,184 | A | 6/1988 | Liang | |
| 4,842,477 | A | 6/1989 | Stowell | |
| 4,887,468 | A | 12/1989 | McKendree et al. | |
| 4,896,537 | A | 1/1990 | Osborne | |
| 4,946,546 | A | 8/1990 | Bourgeois-Moine | |
| 5,043,703 | A | 8/1991 | Dipoala et al. | |
| 5,101,165 | A | 3/1992 | Rickards | |
| 5,167,487 | A | 12/1992 | Rock | |
| 5,479,826 | A | 1/1996 | Twerdochlib et al. | |
| 5,511,426 | A | 4/1996 | Clement et al. | |
| 5,818,242 | A | 10/1998 | Grzybowski et al. | |
| 6,233,822 | B1 | 5/2001 | Grossklaus et al. | |
| 6,454,156 | B1 | 9/2002 | Taras et al. | |
| 6,489,917 | B2 | 12/2002 | Geisheimer et al. | |
| 6,717,418 | B2 * | 4/2004 | Orenstein | 324/644 |
| 6,833,793 | B2 | 12/2004 | Dzieciol et al. | |
| 6,856,281 | B2 | 2/2005 | Billington et al. | |
| 7,013,718 | B2 | 3/2006 | Ingistov et al. | |
| 7,095,221 | B2 | 8/2006 | Bosselmann et al. | |
| 7,283,096 | B2 | 10/2007 | Geisheimer et al. | |
| 7,341,428 | B2 | 3/2008 | Twerdochlib | |
| 7,969,165 | B2 * | 6/2011 | Bosselmann et al. | 324/644 |
| 2004/0196177 | A1 | 10/2004 | Billington et al. | |
| 2005/0264275 | A1 | 12/2005 | Bosselmann et al. | |
| 2006/0088414 | A1 | 4/2006 | Harivel et al. | |
| 2007/0024505 | A1 | 2/2007 | Geisheimer et al. | |
| 2008/0054048 | A1 | 3/2008 | Szela et al. | |

FOREIGN PATENT DOCUMENTS

| | | |
|---|---|---|
| GB | 2 065 410 | 6/1981 |
| GB | 2 344 177 | 5/2000 |
| JP | 10-68617 | 3/1998 |
| WO | 95/35484 | 12/1995 |
| WO | 02/44751 | 6/2002 |
| WO | WO 2008040601 A1 * | 4/2008 |
| WO | 2010/017893 | 2/2010 |

OTHER PUBLICATIONS

Wiedmann, Frank, "The Six-Port Reflectometer," http://www.geocities.com/frank_wiedmann/sixport.html, Nov. 29, 2004.

Kim et al., "A Displacement Measurement Technique using Millimeter-Wave Interferometry," IEEE Transactions on Microwave Theory and Techniques, vol. 51, No. 6, Jun. 6, 2003, pp. 1724-1727.

Gentile, Ken, "Fundamentals of Digital Quadrature Modulation," RF Mixed Signal, www.rfdesign.com, Feb. 2003.

Edwards, D.F. et al., "Multiple-Pass Reflectometer," Nov. 15, 1981, Energy Citations Database, http://www.osti.gov/energycitations/product.biblio.jsp?osti_id=5131992.

* cited by examiner

INSTRUMENT PORT SEAL FOR RF MEASUREMENT

This application is a continuation application of U.S. patent application Ser. No. 11/621,671, which was filed on Jan. 10, 2007.

BACKGROUND OF THE INVENTION

This invention relates to a method of mounting a frequency probe in a turbine engine.

Microwave/radio frequency signals have been used to detect, for example, the position of a target component within a turbine engine. A microwave/radio generator produces a signal that is reflected by the target component and processed to detect information such as the position of the target component.

Current methods of instrumentation in a turbine structure require that a hole be drilled in the metal structure to allow the sensor to function. The hole is required to permit communication with a target component. A mechanical connection is required to attach the sensor to the metal structure to prevent leakage. The mechanical connections pose durability issues.

In one example, microwave/radio frequencies are used to detect the clearance of a turbine blade relative to an adjacent housing. The orifice used to accommodate the microwave/radio frequency instrumentation allows air and debris in the turbine gas path to collect within the sensor thereby degrading its performance. The hole also creates a potential pathway for high pressure secondary cooling air used to cool the blade outer air seal to leak through the hole and into the gas path, creating a performance loss.

With prior art methods it is difficult to reliably determine the proximity of the rotating turbine blades relative to the turbine case. What is needed is a method and apparatus for preventing contamination of the sensor and leakage between the cooling path and turbine gas path. What is also needed is a reliable way of establishing an absolute position of the sensor relative to the turbine blades.

SUMMARY OF THE INVENTION

An apparatus includes a blade clearance detection system. A probe is configured to communication detection frequencies from and gather reflected signals for the blade tip detection system. The probe has an end supported relative to the casing. A material provides a reference point. The blade tip clearance detection system is configured to generate a first detection frequency configured to pass through the material to detect the position of a target structure, generate a second detection frequency configured to reflect from and detect the reference point, and determine a position of a surface approximate to the target structure based upon the reference point.

A method of detecting blade tip clearance, in one example, is provided by generating a first detection frequency that passes through a material supported relative to a casing. The first detection frequency is reflected from a target structure. A second detection signal is generated and reflected from a reference point provided by the material. A clearance is determined between the target structure and a surface associated with the case and based upon the reference point.

These and other features of the present invention can be best understood from the following specification and drawings, the following of which is a brief description.

DETAILED DESCRIPTION OF THE PREFERRED EMBODIMENT

Figure 1:
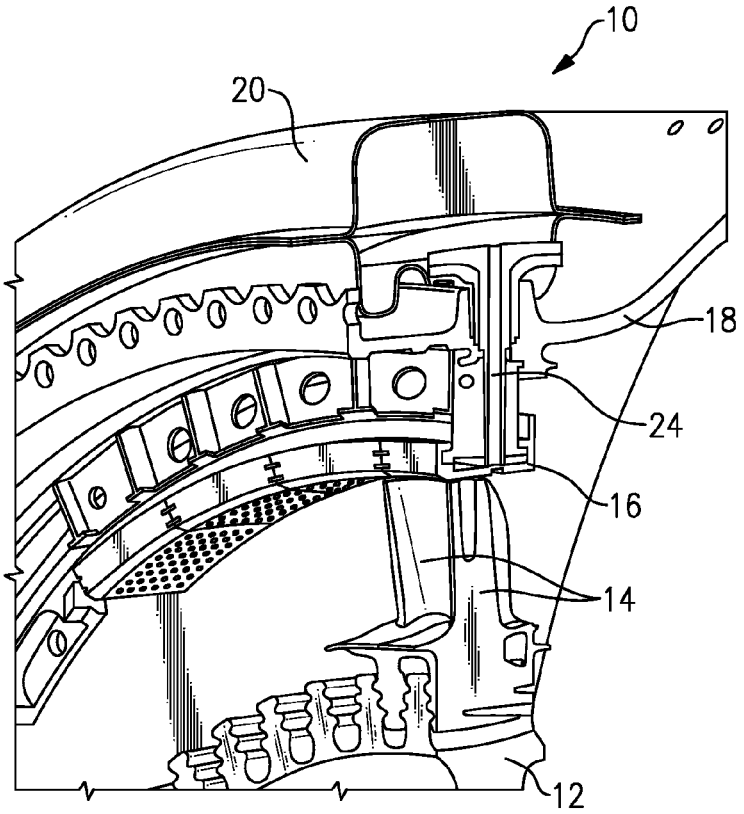
FIG. 1 is a partially broken perspective view of a turbine section of a turbine engine.

A turbine section of a gas turbine engine 10 is shown in FIG. 1. The engine 10 includes a hub 12 having multiple turbine blades 14 secured to the hub 12. A housing, such as blade outer air seal (BOAS) 16, is arranged about the turbine blades 14 near their tips. A casing 18 supports the BOAS 16. Cooling ducts 20 are supported on the casing 18 near the BOAS 16 to control the clearance between the tips and BOAS 16 by selectively controlling cool air through the cooling duct 20, as is known in the art. A probe 24 is supported in the casing 18 and extends to the BOAS 16. The probe 24 is part of a position detection system, shown in FIG. 3, that monitors tip clearance.

Figure 3:
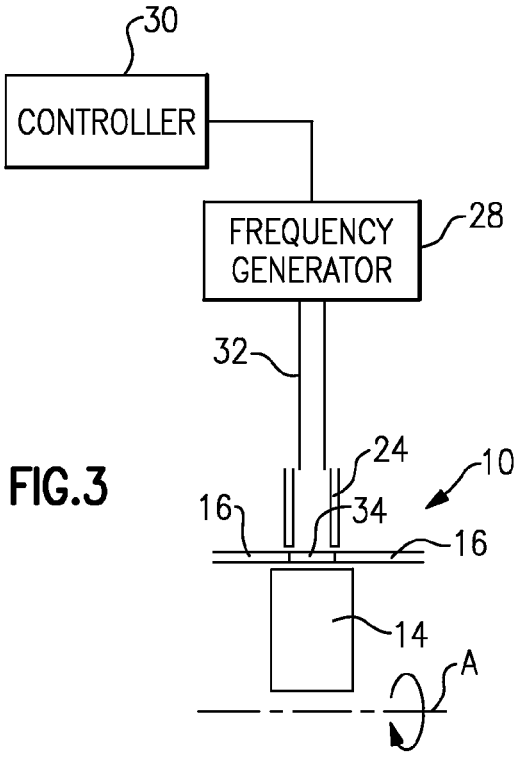
FIG. 3 is a schematic view of the turbine section shown in FIG. 1 and including a position sensing system.

Referring to FIG. 3, the tip clearance detection system includes a frequency generator 28 operable in response to commands from a controller 30. The frequency generator 28 produces a detection frequency including microwave/radio frequencies, in one example. The detection frequency produced by the frequency generator 28 travels along a conduit 32 to the probe 24. It is desirable for the detection frequency to travel generally uninhibited from the probe 24 to the turbine blade 14. As the turbine blades 14 rotate about an axis A, the tip clearance detection system monitors the clearance between the tip of the turbine blades 14 and the BOAS 16. Prior systems have simply provided an aperture in the BOAS 16, which undesirably permits cooling air from the cooling duct 20 to enter the turbine section. A mechanical connection between the conduit 32 and the BOAS 16 was required to prevent leakage, but contributed to durability concerns. Additionally, any holes in the housing enable debris to contaminate the probe 24. It should be understood that the above described detection system can be used to detect other information within the gas turbine engine 10 or other aircraft systems.

Figure 2:
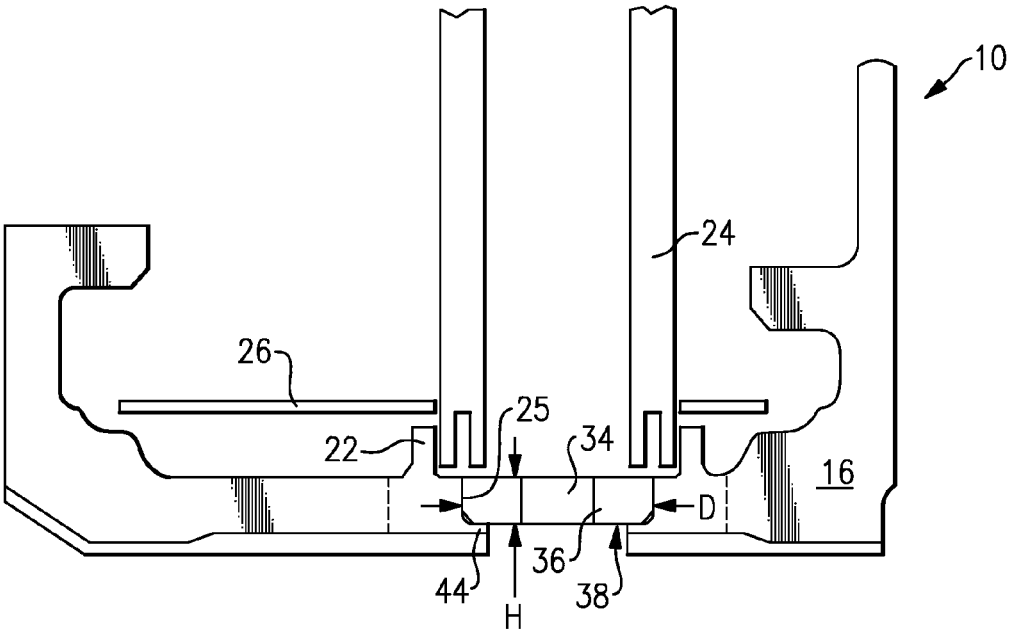
FIG. 2 is and enlarged view of a portion of the cross-section shown in FIG. 1.
Figure 4:
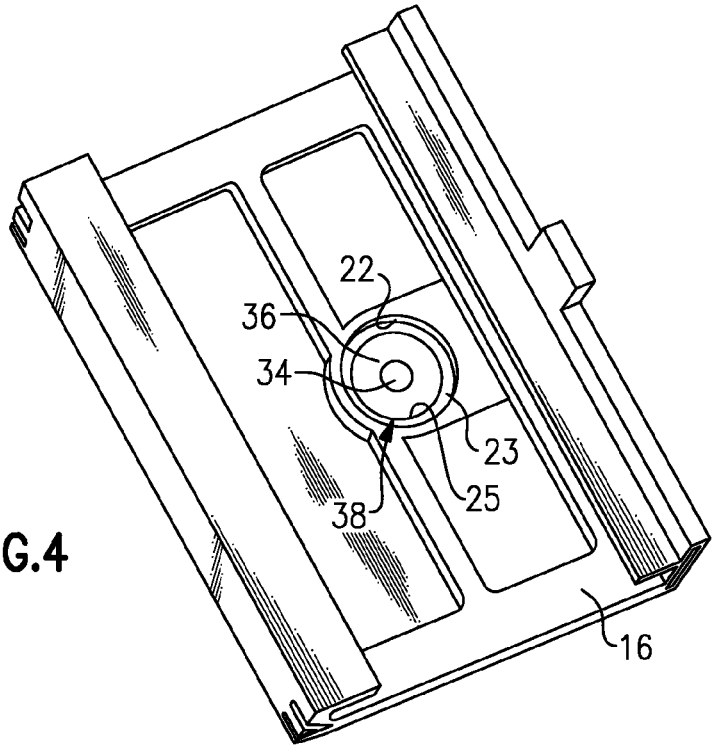
FIG. 4 is a top perspective view of a blade outer air seal.

Referring to FIGS. 2 and 4, the probe 24 is securely retained relative to the BOAS 16 so that the clearance between the BOAS 16 and the adjacent turbine blade 14 can be detected. The BOAS 16 typically includes an impingement plate 26 that is supported between the casing 18 and the BOAS 16. An aperture is provided in the impingement plate 26 to accommodate the probe 24. In the example shown, the BOAS 16 includes a boss that provides a channel ring 22. The channel ring 22 has a recess 23, which is best shown in FIG. 4, to receive an end of the probe 24. In the example, the impingement plate 26 and channel ring 22 retain the probe 24 axially and circumferentially.

The BOAS 16 is typically constructed from a metallic material such as an Inconel®. While Inconel® is a desirable structural material typically used in blade outer air seals, Inconel® blocks the passage of microwave/radio frequencies, which can prevent the communication between the turbine blades 14 and probe 24. In the example, a hole 25 is provided near the end of the probe 24. A window material 34 is supported within the hole 25. The window material 34 is transparent to the detection frequency, permitting communication between the detection frequency and the turbine blade 14. By "transparent" it is meant that the window material 34 permits desired passage of the detection frequency. Said another way, the window material 34 comparatively permits a better quality passage of the detection frequency relative to the housing.

The window material 34 is a polycrystalline, single crystalline or ceramic material, for example. In one example, the window material 34 is a metalized alumina. Other example materials include quartz, diamond, Zirconia toughened alumina, unmetalized alumina, or other materials that are transparent to the detection frequency as known by someone skilled in the art.

Figure 7:
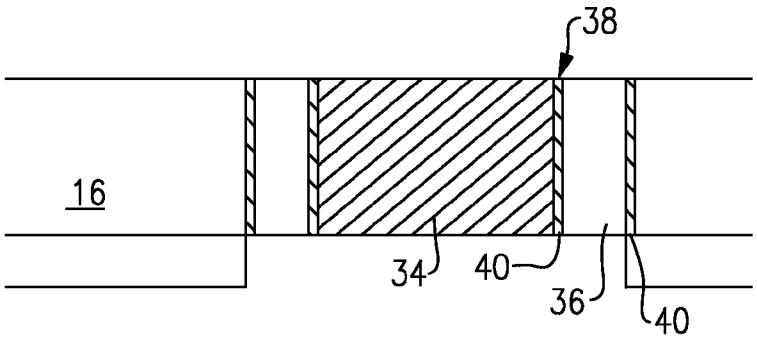
FIG. 7 is an enlarged view of the example port seal subassembly shown in FIGS. 2 and 4.

In the examples shown in FIGS. 2, 4 and 7, the window material 34 is supported by a carrier 36 that provides a subassembly 38. The dimensions of the window material 34 are so small in some applications that it presents assembly difficulties for the turbine engine assembler. By providing a carrier arranged about the window material 34, a larger subassembly 38 is provided that can more easily be manipulated by the assembler.

In one example, a shoulder 44 is provided at one end of the hole to axially locate the subassembly 38. The subassembly 38 including the window material 34 and carrier 36 are machined to a precise height H and diameter D for the typical application. The height H can be precisely machined by polishing, for example, so that an accurate determination of tip clearance can be made. The diameter D can be achieved using an electrical discharge machining process, for example. The window material 34 acts as a reference point to enable more precise measurement of the blade tip clearance. For example, another frequency can be transmitted through the probe 24 that will not pass through the window material 34. The signal reflected from the window material 34 can be used for reference when determining the clearance between the BOAS 16 and blade tip. The carrier 36 may extend radially beyond the channel ring 22 to include the channel ring 22 for better location of the end of the probe 24 relative to the housing 16. Such a carrier 36 is schematically illustrated by the dashed lines in FIG. 2.

Referring to FIG. 7, the window material 34, which is a metalized alumina in the example, is brazed to the carrier 36 using a brazing material 40. In one example, the carrier 36 is an Inconel® like the BOAS 16. The window material 34 and carrier 36 provide a subassembly 38 that is brazed to the BOAS 16 using a brazing material 40. After securing the subassembly 38 to the BOAS 16, the height H of the subassembly 38 can be achieved by machining.

Figure 6:
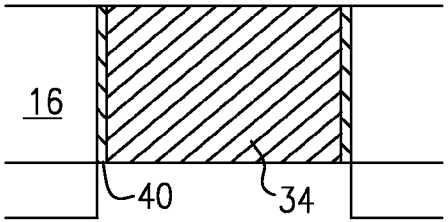
FIG. 6 is another example of a port seal subassembly.
Figure 5:
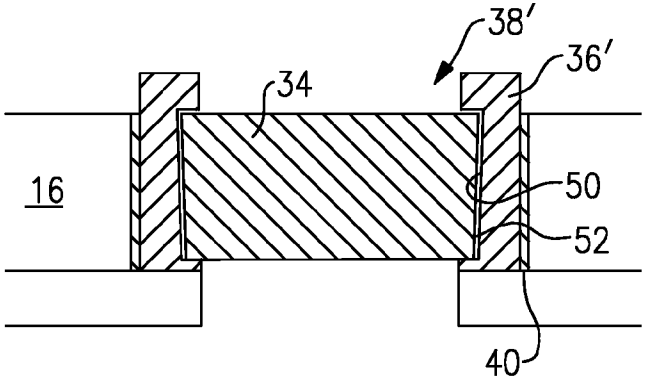
FIG. 5 is one example of a port seal subassembly.

Other example arrangements are shown in FIGS. 5 and 6. Referring to FIG. 5, a subassembly 38' is provided by a carrier 36' having a annular groove 50 machined in its inner diameter. The window material 34 is retained by the carrier 36' and captured within the annular groove 50. The outer diameter of the window material 34 and inner diameter include tapered surfaces 52 for improved retention of the window material 34. The subassembly 38' is secured to the BOAS 16 using a brazing material 40. Referring to FIG. 6, the window material 34 is directly secured to the BOAS 16 using brazing material 40.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. An apparatus comprising:

a blade tip clearance detection system;

a probe configured to communicate first and second detection frequencies from and gather reflected signals for the blade tip detection system, the probe having an end supported relative to a casing;

material providing a reference point; and wherein the blade tip clearance detection system is configured to:

generate the first detection frequency configured to pass through the material to detect the position of a target structure;

generate the second detection frequency configured to reflect from the material and detect the reference point; and determine a position of a surface proximate to the target structure based upon the reference point.

2. The apparatus according to claim 1, wherein the blade tip detection system includes a controller and a frequency generator.

3. The apparatus according to claim 1, wherein the casing includes a blade outer air seal providing the surface.

4. The apparatus according to claim 3, wherein the target structure is a turbine blade including a blade tip.

5. The apparatus according to claim 4, wherein the surface position is determined by determining a clearance between the blade outer air seal and the blade tip.

6. The apparatus according to claim 1, wherein the material is transparent to the first detection frequency.

7. The apparatus according to claim 1, wherein the material includes a machined surface to provide a desired height that provides the reference point.

* * * * *